United States Patent [19]

Mosby

[11] 3,945,492

[45] Mar. 23, 1976

[54] DUAL FUNCTION ELECTRICAL SWITCH

[75] Inventor: Geoffrey Ralph Mosby, Sutton Coldfield, England

[73] Assignee: Lucas Electrical Company Limited, Birmingham, England

[22] Filed: Oct. 4, 1973

[21] Appl. No.: 403,718

[30] Foreign Application Priority Data

Oct. 4, 1972 United Kingdom ..... 45723/72

[52] U.S. Cl. ..... 200/246; 200/6 C; 200/159 A

[51] Int. Cl.[2] ..... H01H 1/26

[58] Field of Search ..... 200/4, 6 A, 1 A, 166 J, 200/159 A, 283, 246, 6 R, 6 C

[56] References Cited

UNITED STATES PATENTS

| | | | |
|---|---|---|---|
| 1,280,831 | 10/1918 | Pitkethly | 200/4 |
| 1,625,149 | 4/1927 | Petnel | 200/6 A |
| 2,507,381 | 5/1950 | Morse | 200/159 A X |
| 3,488,461 | 1/1970 | Webb | 200/61.44 X |

*Primary Examiner*—Robert K. Schaefer
*Assistant Examiner*—William J. Smith
*Attorney, Agent, or Firm*—Holman & Stern

[57] ABSTRACT

An electrical switch including first and second fixed electrical contacts carried by the body of the switch. Fastened to the body is an L-shaped flexible strip which carries first and second movable contacts, one end of one limb of the L-shaped strip being secured to the body. In order to engage the first movable contact with the first fixed contact the strip is flexed along the length of said one limb, and in order to engage the second movable contact with the second fixed contact the strip is twisted along the length of said one limb.

5 Claims, 2 Drawing Figures

DUAL FUNCTION ELECTRICAL SWITCH

This invention relates to electrical switches.

A switch according to the invention includes first and second fixed electrical contacts, and an L-shaped flexible strip carrying first and second movable contacts, one end of one limb of the strip being fixed and the strip, in use, being flexed along the length of said one limb to engage the first movable contact with the first fixed contact and being twisted along the length of said one limb to engage the second movable contact with the second fixed contact.

Conveniently the movable contacts are defined by regions of the strip.

Preferably the movable contacts are defined by contact members carried by the strip.

Desirably the two limbs of the strip lie in perpendicular planes, the junction of the two limbs extending at right angles to the longitudinal axes of the limbs, the first fixed contact being carried by said one limb and the second fixed contact being carried by the other limb, said other limb being moved longitudinally to flex said one limb and being moved laterally in its own plane to twist said one limb.

Preferably the switch includes a body to which the first and second fixed contacts and said one end of said one limb of the strip are secured, the free end of said other limb of the strip carrying an operating member which extends through an aperture in the body with sufficient clearance to permit the necessary longitudinal and lateral movement.

Figure 1:
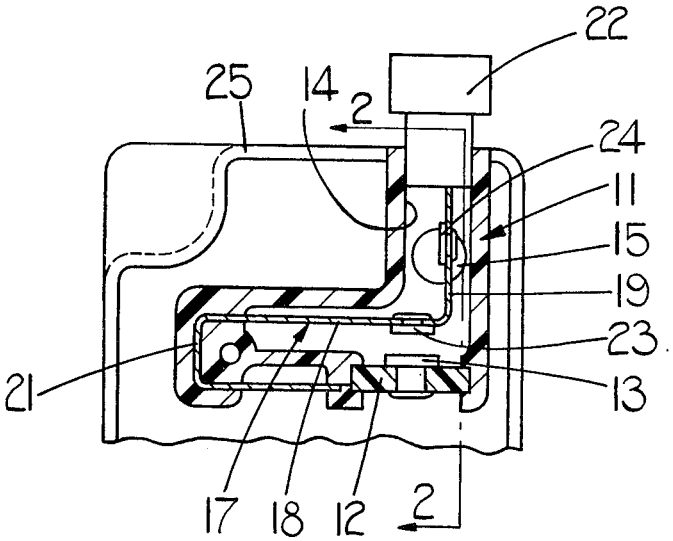
Figure 2:
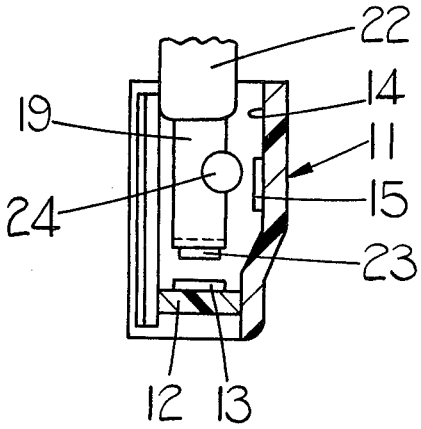

One example of the invention is illustrated in the accompanying drawings wherein FIG. 1 is a sectional view of an electrical switch, and FIG. 2 is a fragmentary sectional view of the switch on the line 2—2 in FIG. 1. de Referring to the drawings, the switch includes a hollow moulded synthetic resin body 11 the portions of the lower wall of which is closed by an insulating board 12 carrying a first fixed contact 13. The body 11 includes an open ended channel portion 14 and mounted on an inner wall of the channel portion 14 so as to be disposed in a plane at 90° to the contact 14 is a second fixed contact 15.

Mounted within the body 11 is an L-shaped phosphor bronze strip 17 having a first limb 18 within the major portion of the body and a second limb 19 extending within the channel 14. The end of the limb 18 remote from the junction of the limbs 18, 19 has integral therewith a keying portion 21 which is embedded in the wall of the body 11 so that one end of the limb 18 is fixed with respect to the body 11, The keying portion 21 projects from the body, and defines an electrical terminal whereby electrical connection can be made to the strip 17. The limbs 18, 19 of the strip 17 lie in perpendicular planes, so that the junction of the limbs 18, 19 extends at right angles to the longitudinal axes of the limbs 18, 19. The free end of the limb 19 carries a moulded synthetic resin operating member 22 which projects from the open end of the channel 14, and adjacent the junction of the limbs 18, 19 the limb 18 carries a first movable contact member 23. The strip 17 is of course flexible, and by depressing the operating member 22 towards the body 11 the limb 19 is moved substantially longitudinally, and the limb 18 is flexed along its length to engage the contact member 23 with the fixed contact 13, and so complete an electrical circuit between a terminal associated with the contact 13, and the terminal region of the keying portion 21 integral with the strip 17.

The operating member 22 engages opposite faces of the channel 14, but there is a clearance between the front and rear walls of the channel, and the front and rear surfaces of the operating member 22 so that the operating member 22 can be moved relative to the channel 14 in a manner to twist the limb 18 of the strip 17 about its longitudinal axis. Thus by so moving the operating member 22 a second movable contact member 24 carried by the limb 19 can be moved into engagement with the fixed contact 15 on the inner wall of the channel 14. Such lateral movement of the operating member 22 causes lateral movement of the limb 19, and twisting of the limb 18 and establishes an electrical circuit between a terminal member associated with the contact 15 and the terminal region of the keying portion 21 integral with the strip 17.

It will be appreciated that both deformations of the limb 18 of the strip 17 take place against the inherent resilience of the limb 18, and so upon release of the operating member 22 the strip 17 will return to a rest configuration wherein both electrical circuits are broken. Moreover, the diameter of the fixed contact 15 and the positioning of the movable contact 24 are so chosen that the limb 19 can be moved laterally to engage the movable contact 24 with the fixed contact 15 in the flexed position of the limb 18 wherein the moving contact 23 is engaged with the fixed contact 13. Thus if desired both electrical circuits can be completed simultaneously.

The body 11 is, in one practical embodiment, secured to a moulded synthetic resin cover member 25 which carries a plurality of further switches. The cover member 25 is intended to be secured to for example the handle bars of the motor cycle, and the two circuits controlled by the switch can be a headlamp circuit, and a horn circuit of the motor cycle. The further switches carried by the cover 25 can for example be the main lighting switch and a direction indicator switch.

I claim:

1. An electrical switch including an L-shaped flexible strip, first and second movable contacts carried by the strip, first and second fixed electrical contacts associated with the first and second movable contacts respectively, one end of one limb of the strip being fixed, and said first and second fixed electrical contacts being so positioned relative to one another that the first movable contact can be engaged with the first fixed contact by flexing said one limb of the strip along its length, the second movable contact being engageable with the second fixed contact by twisting said one limb along its length.

2. A switch as claimed in claim 1 wherein the movable contacts are defined by regions of the strip.

3. A switch as claimed in claim 1 wherein the movable contacts are defined by contact members carried by the strip.

4. A switch as claimed in claim 1 wherein the two limbs of the strip lie in perpendicular planes, the junction of the two limbs extending at right angles to the longitudinal axes of the limbs, the first fixed contact being carried by the other limb, said other limb being moved longitudinally in its own plane to twist said one limb.

5. A switch as claimed in claim 1 further including a body to which the first and second fixed contacts and said one end of said one limb of the strip are secured, the free end of said other limb of the strip carrying an operating member which extends through an aperture in the body with sufficient clearance to permit the necessary longitudinal and lateral movement.

* * * * *